US006394273B1

(12) United States Patent
Dixon

(10) Patent No.: US 6,394,273 B1
(45) Date of Patent: May 28, 2002

(54) CARTON WITH SUPPLEMENTAL INFORMATION PANEL

(75) Inventor: Rodney D. Dixon, Burlington, NC (US)

(73) Assignee: MPC Packaging Corporation, Mebane, NC (US)

( * ) Notice: Subject to any disclaimer, the term of this patent is extended or adjusted under 35 U.S.C. 154(b) by 0 days.

(21) Appl. No.: 09/580,760

(22) Filed: May 30, 2000

(51) Int. Cl.[7] ..... B65D 85/00

(52) U.S. Cl. ..... 206/459.5; 206/831; 206/232; 40/312

(58) Field of Search ..... 206/831, 459.5, 206/232; 40/312

(56) References Cited

U.S. PATENT DOCUMENTS

| | | | | | |
|---|---|---|---|---|---|
| 223,432 | A | * | 1/1880 | Brooks | 283/71 |
| 3,062,430 | A | | 11/1962 | Rutledge | 229/37 |
| 3,099,381 | A | | 7/1963 | Meyers | 229/37 |
| 3,147,856 | A | * | 9/1964 | Lightner | 206/232 |
| 3,214,075 | A | | 10/1965 | Champlin et al. | 229/16 |
| 3,335,937 | A | | 8/1967 | Kramer | 229/38 |
| 3,580,489 | A | * | 5/1971 | Oettinger | 229/70 |
| 3,606,135 | A | | 9/1971 | Rosenburg, Jr. | 229/37 |
| 4,103,820 | A | | 8/1978 | Mathison et al. | 229/37 R |
| 4,108,350 | A | | 8/1978 | Forbes, Jr. | 229/37 R |
| 4,320,830 | A | | 3/1982 | Roccaforte | 206/45.19 |
| 4,344,533 | A | | 8/1982 | Olsen | 206/459 |
| 4,620,664 | A | * | 11/1986 | Kaufman et al. | 229/233 |
| 4,834,240 | A | | 5/1989 | Dagostine | 206/459 |
| 4,838,424 | A | * | 6/1989 | Petzelt | 206/459.5 |
| 4,872,555 | A | | 10/1989 | Shadrach, III et al. | 206/459 |
| 4,949,845 | A | | 8/1990 | Dixon | 206/626 |
| 4,993,845 | A | * | 2/1991 | Faltynek | 383/40 |
| 5,072,877 | A | | 12/1991 | Van Fulpen | 229/155 |
| 5,074,462 | A | | 12/1991 | Countee, Jr. | 229/155 |
| 5,082,113 | A | | 1/1992 | Romick | 206/459 |
| 5,282,534 | A | * | 2/1994 | Lapp | 206/232 |
| 5,341,923 | A | | 8/1994 | Arasim | 206/214 |
| 5,363,955 | A | * | 11/1994 | Fleenor | 206/273 |
| 5,697,549 | A | | 12/1997 | Yocum | 229/400 |
| 6,068,115 | A | * | 5/2000 | Boulton | 206/232 |

* cited by examiner

*Primary Examiner*—Mickey Yu
*Assistant Examiner*—Troy Arnold
(74) *Attorney, Agent, or Firm*—Womble Carlyle Sandridge & Rice, PLLC

(57) ABSTRACT

A carton for packaging articles, having at least one supplemental information panel hingedly connected to one of the wall panels. The supplemental information panel is disposed inside the carton and can be withdrawn through an access port formed in one of the wall panels.

7 Claims, 2 Drawing Sheets

CARTON WITH SUPPLEMENTAL INFORMATION PANEL

BACKGROUND OF THE INVENTION

The present invention relates generally to folding cartons and, more particularly, to a folding carton having at least one supplemental information panel providing additional space for the printing of indicia thereon.

For many years, manufacturers have packaged products of many types and sizes in paperboard cartons. For items manufactured and packaged for resale, manufacturers often utilize the surfaces of the cartons for distinctive, catchy advertising, intended to induce consumers to purchase the product. As consumer product and product liability standards have evolved in recent decades, manufacturers have been required to print increasing amounts of consumer protection information directly on the outside of cartons, or in the alternative, on paper inserts placed in the cartons with the product. Further, many regulatory warnings are now required to be of a particular type or size. This has increased the need for printing area, whether on the outside of cartons or on the paper inserts packaged with the product. While printed paper inserts are relatively inexpensive to produce, considerable difficulty is involved in folding the inserts and placing them in the cartons. There is also considerable effort and expense involved in making sure the correct insert is placed in the corresponding package, as a mistake can have extremely bad consequences. Also, quite often, after purchase consumers never remove the inserts from the cartons, simply discard them or they otherwise become removed from the carton.

The prior art discloses cartons having an additional separable panel directed to providing recipes or coupons. The additional panel may not be reattached, and is permanently separated from the carton. There is further known a one-piece carton having an integral coupon card in a side panel that may be detached from the carton along a perforated line, but the construction of the carton and coupon is not directed to additional printing area and cannot be returned to its original configuration once opened. There are also known in the art cartons having fifth panels for supporting the cartons from displays or for use as closure flaps once the cartons have been initially opened by means of removable tear strips or the like.

SUMMARY OF THE INVENTION

The present invention is directed to a carton for packaging articles wherein at least one supplemental information panel provides substantially more printing space for instructions, consumer information, or regulatory warnings. The present invention provides such a carton whereby a purchaser can access and view instructions, information, and warnings without detaching them from the body of the carton. Thus the carton is still usable with the information intact.

Accordingly, one aspect of the present invention is to provide a carton for packaging articles that includes an integrally-formed supplemental information panel in addition to the coated side walls such that printing, images, or other indicia may be printed on each of the outer surfaces and on the supplemental information panel. Desirably, all outer surfaces, as well as the additional panels, are coated with a water-soluble silicon based coating suitable for printing thereon and sufficiently heat resistant to withstand printing. One such coating is manufactured by Kelstar Enterprises, Inc. as Item ACC222.

To provide additional printing surface area, at least one supplemental information panel is connected to the inside surface of one of the carton wall panels and accessible through an access port normally closed by a perforated hinged closure panel. At least one of the surfaces of this supplemental information panel is coated for printing. Desirably, the supplemental information panel is formed from two or more connected panels that are attached in hinge-like fashion in series and folded one upon the other. The supplemental information panel so formed is folded over and disposed within the carton when the carton is being shipped, stored, or displayed for sale to consumers. The access port or tear-away panel, smaller in size than and formed in one of the wall panels, is hingedly connected to one of the wall panel side edges such that, when opened, the supplemental information panel may be withdrawn from within the carton through the access port or tear-away panel.

Another aspect of the present invention is to provide a single blank for folding into a carton and having a plurality of adjacent wall panels, a supplemental information panel, and end closure panels. The blank is comprised of multiple rectangular panels. A coating is conventionally provided on one surface of the blank for printing, images, or other indicia. The box is so folded that the coated side forms the exterior of the box and the uncoated side forms the interior of the box.

These and other aspects of the present invention will become apparent to those skilled in the art after a reading of the following description of the preferred embodiment when considered with the drawings.

DESCRIPTION OF THE PREFERRED EMBODIMENTS

Figure 1:
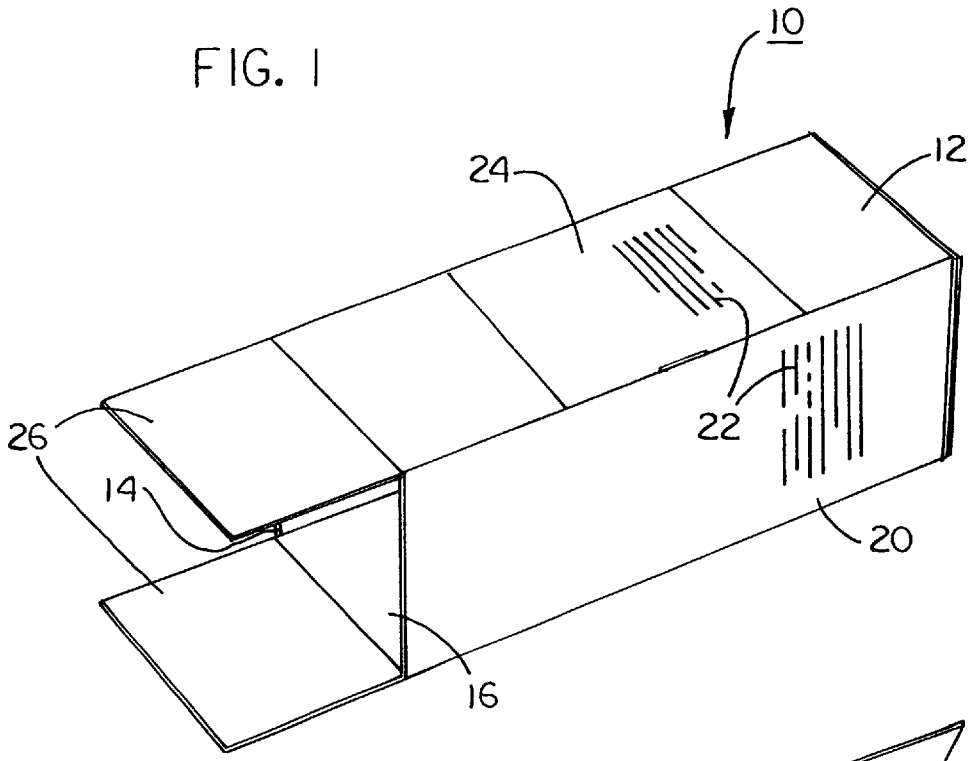
FIG. 1 is a front perspective view of a carton constructed according to the present invention with the access port or tear-away panel in the closed position.
Figure 3:
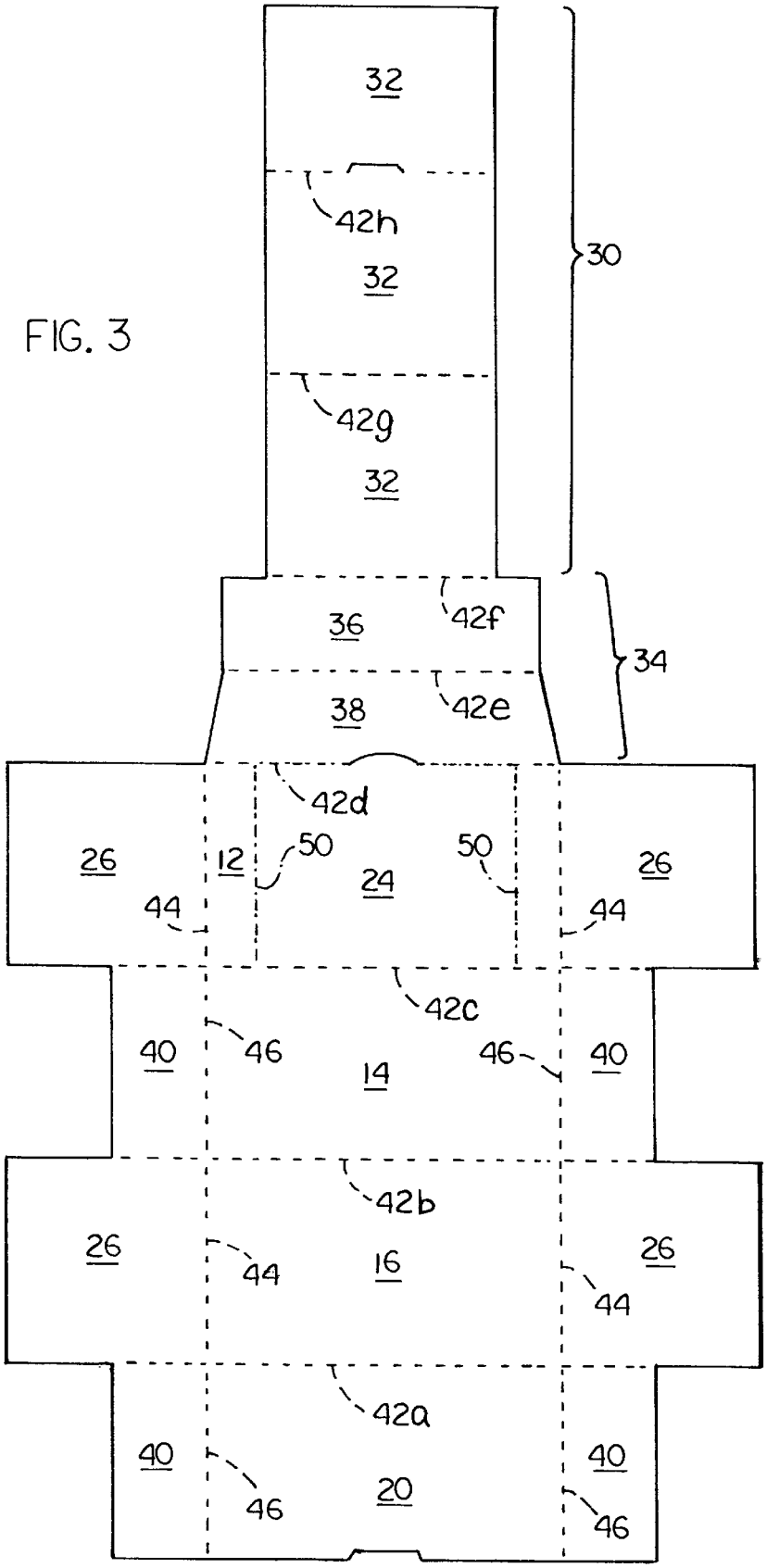
FIG. 3 is a plan view of a blank foldable sheet material from which a carton constructed according to the present invention may be formed.

Referring now to the drawings in general and FIG. 1 in particular, it will be understood that the illustrations are for the purpose of describing a preferred embodiment of the invention and are not intended to limit the invention thereto. As best seen in FIGS. 1 and 3, a carton constructed according to the present invention, generally designated 10, includes wall panels 12, 14, 16, and 20, all hingedly connected along fold lines. The carton 10 may be formed from a unitary blank of foldable sheet material such as paperboard where the weight of the paperboard used in the construction of carton 10 is dependent upon the weight of the articles being packaged. Desirably, one complete surface of the sheet material is coated such that printing, images, and other indicia 22 may be applied thereto. The coating is conventionally a water-soluble silicon based material or other coating material that is suitable for printing thereon and sufficiently heat resistant to withstand printing and hot glue adhesion. One such coating is manufactured by Kelstar Enterprises, Inc. as Item ACC222.

As seen in FIGS. 1 and 3, the preferred embodiment of carton 10 includes end closure panels 26 of substantially the same size and shape hingedly connected to the ends of wall panels 12 and 16. Upon placing an article in the carton 10, end closure panels 26 may be folded down one upon the other and sealed closed with any suitable form of adhesive. Where repetitive opening and closing of the carton is desired, any suitable releasable adhesive may be selected therefor. Such adhesives are available from Henkel Adhesives Corporation as Item 80-8512 or from National Starch and Chemical Company as Item 34-2602.

Figure 2:
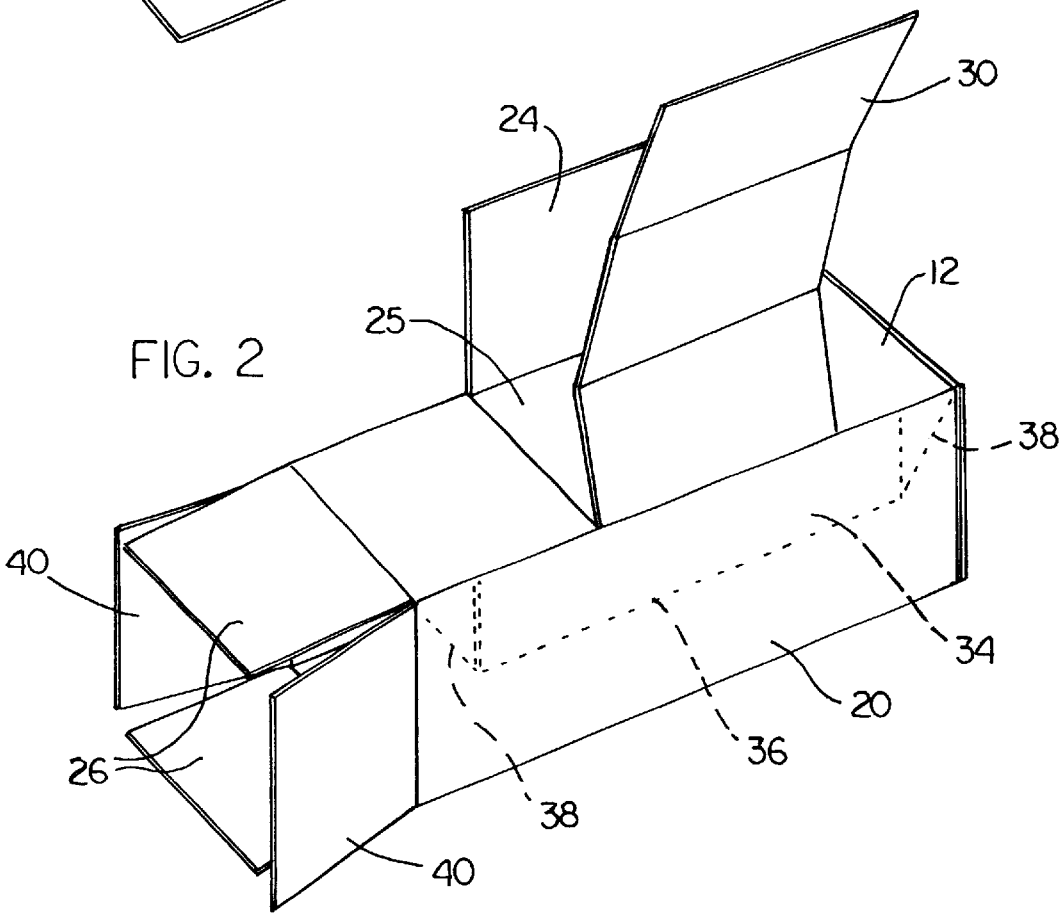
FIG. 2 is a front perspective view similar to FIG. 1 except illustrating the supplemental information panel in the withdrawn, unfolded position.

As best seen in FIGS. 2 and 3, depending upon the article to be packaged, it may be desirable to employ closure tabs 40 in addition to end closure panels 26. The closure tabs 40 are substantially the same size and may be hingedly connected to the ends of wall panels 14 and 20. Closure tabs 40 are folded inward over the end opening of carton 10 before end closure panels 26 are folded inward and sealed. Alternatively, a single end closure panel and closure tab could be used to close at least one end of carton 10.

The configuration of walls 12, 14, 16, and 20, closure panels 26, and closure tabs 40 is conventional. According to the present invention an access port 25 is formed by a tear-away panel 24 that is hingedly connected to wall 14, and the carton is provided with a supplemental information panel 30 sized to be extensibly withdrawn through access port 25. As best seen in FIGS. 1 and 2, access port 25 is smaller in size than and formed in wall panel 12, and formed by tear-away or tear-back panel 24 being hingedly connected to an edge of wall panel 14. Supplemental panel 30 is desirably comprised of at least two panels 32 hingedly connected together in series along fold lines, whereby supplemental panel 30 is then preferably hingedly connected to one of the free edges of one of wall panels 14. Supplemental information panel 30 may be foldably disposed within carton 10, or in the alternative, panels 32 may be releasably adhered one upon the other and disposed with carton 10 or folded one upon the other in accordion fashion and disposed within carton 10.

As best seen in FIGS. 2 and 3, carton 10 may include at least one connecting panel 34 integrally formed with carton 10 and adhered to wall panel 20. Connecting panel 34 may be a single panel, or in the alternative, may preferably be comprised of two smaller panels 36 and 38 hingedly connected such that panel 38 is adhered to wall panel 20 and panel 36 is folded over and adhered to panel 38. This permits panels 32 to be easily disposed within carton 10 and properly aligned with either wall panel 12 or wall panel 20. Alternatively, connecting panel 34 may be separately formed. In such case, connecting panel 34 could consist of a single panel and could easily be adhered to the inside surface of wall panel 14, 16, or 20.

Turning now to FIG. 3, the blank forming a carton constructed according to the present invention is shown. As can be seen, the blank is in the form of a single planar unitary sheet of cardboard or paperboard in which one surface is coated and printed. The main body of the carton is formed from four substantially rectangular panels 12, 14, 16, and 20. These panels are linked to each other by means of horizontal folding lines 42*a,* 42*b,* and 42*c,* which facilitate folding of the carton panels relative to each other. Each of panels 12, 14, 16, and 20 is provided with a pair of closure tabs 40 or end closure panels 26 connected along respective transverse edges by means of corresponding score lines 44 or 46.

In forming a carton from the blank according to the present invention, wall 20 and wall 16 are formed by folding rectangular panels along fold line 42*a*. Likewise, wall 14 and 12 are formed by folding the blank panels along fold lines 42*b* and 42*c*. Closure of the carton is accomplished by folding inward and securing the rear side of connecting panel 34 to wall 12 along tear line 42*d,* to wall 20. Where panel 34 is comprised of two panels, 36 and 38, panel 38 is secured to wall 20 and panel 36 is folded over along fold line 42*e* and adhered to panel 38. This allows maximum usage of the coated, printable surface for additional information.

Supplemental information panel 30 is formed of adjacent panels 32 that are hingedly connected together and extend upward from fold line 42*f* on panel 34. Each of panels 32 must be so dimensioned that the information panel can be extended through the access port 25. Therefore, preferably the length and width of panels 32 is slightly less than the corresponding dimensions of access port 25. Panels 32 are folded one upon the other along fold lines 42*g* and 42*h*. At least one surface of panels 32 is coated for the printing of indicia thereon. Once formed, supplemental information panel 30 is disposed within carton 10 and can be withdrawn when panel 24, formed in wall panel 12, is releasably opened via tear lines 42*d* and 50.

Closure of carton 10 is achieved by first folding inwardly closure tabs 40 along fold lines 46. End closure panels 26 are then folded inward along fold lines 44. End closure panels 26 are then releasably adhered one upon the other. In the alternative, the end closure panels 26 on at least one end of carton 10 may be reclosably adhered, thus permitting repetitive opening and sealing of carton 10.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A blank for folding into a carton having an extended information panel, said blank comprising:

(a) a plurality of wall panels, all of which are substantially the same size and shape and which are hingedly connected together along side edges forming a plurality of inner panels, each connected on one side to an adjacent panel and the other side to an outer panel, each of which includes a free side edge not connected to one of said side panels, said panels having end edges;

(b) an access port smaller in size and shape than and formed in one of said wall panels, said access port formed by a tear-away panel hingedly connected to one of said wall panel side edges; and (c) at least one extended panel formed of at least two hingedly connected adjacent panels extending outwardly from and hingedly connected to one of said free side edges of one of said outer wall panels.

2. The carton of claim 1 wherein said information panel includes a purality of panels hingedly connected in accordion style, each of which is smaller in length and width than said access port, whereupon said information panel is foldably disposed within said carton during shipment and before sale and use.

3. The carton of claim 2 wherein said at least one extended panel further includes a connecting panel between said information panel and said one of said side edges of said one wall panel to which the information panel is to be hingedly connected to, said connecting panel being foldable against and adhered to the inner surface of said one wall panel.

4. The blank of claim 1 wherein the end edges of at least some of the wall panels have end flaps hingedly connected thereto.

5. The blank of claim 1, further comprising a coating on at least one surface thereof for printing thereon.

6. A carton for packaging items, said carton comprising:

a. a plurality of wall panels, each of said panels having side edges and first and second end edges, and coated outer surfaces for printing thereon b. an access port smaller in size than and formed in one of said wall panels, said access port formed by a tear-away panel hingedly connected to one of said wall panel side edges;

c. at least one supplemental information panel integral with and hingedly connected to one of the side edges of one of the wall panels and connected to an interior surface of said carton, the information panel including a plurality of panels hingedly connected in accordion style, each of which is smaller in length and width than said access port, whereupon said information panel is foldably disposed within said carton during shipment and before sale and use, and wherein said supplemental information panel is sized to be extensively withdrawn through said access port when said tear-away panel is opened;

d. a connecting panel between said information panel and said one of said side edges of said one wall panel to which the information panel is to be hingedly connected said connecting panel being comprised of two panels hingedly connected together and releaseably adhered to one another, and being foldable against and adhered to the inner surface of said one wall panel;

e. wherein said at least one supplemental information panel normally is disposed within said carton, but available for informational purposes when withdrawn.

7. The carton of claim 1 wherein said carton is formed from a single carton blank.

* * * * *